US007677179B2

(12) United States Patent
Payne

(10) Patent No.: US 7,677,179 B2
(45) Date of Patent: Mar. 16, 2010

(54) VEHICLE AND TRACK SYSTEM FOR FLYING CORNER AMUSEMENT PARK RIDES

(75) Inventor: Joel Neill Payne, Pasadena, CA (US)

(73) Assignee: Disney Enterprises, Inc., Burbank, CA (US)

( * ) Notice: Subject to any disclaimer, the term of this patent is extended or adjusted under 35 U.S.C. 154(b) by 60 days.

(21) Appl. No.: 12/026,638

(22) Filed: Feb. 6, 2008

(65) Prior Publication Data

US 2009/0193997 A1 Aug. 6, 2009

(51) Int. Cl.
*A63G 21/04* (2006.01)

(52) U.S. Cl. ..... 104/69; 104/53; 104/59

(58) Field of Classification Search ..... 104/53, 104/59, 69, 70, 73, 119, 124, 125, 242; 105/144
See application file for complete search history.

(56) References Cited

U.S. PATENT DOCUMENTS 3,114,332 A 12/1963 Bacon
3,631,805 A 1/1972 Schwarzkopf
4,201,137 A * 5/1980 Lagsdin ..... 104/69
4,236,454 A 12/1980 Erickson et al.
4,246,846 A 1/1981 Betschart
4,335,658 A 6/1982 VanderKelen
5,566,620 A * 10/1996 Siewert ..... 104/124
5,797,330 A * 8/1998 Li ..... 104/28
6,550,392 B2 4/2003 Albrich

OTHER PUBLICATIONS

Bobsled roller coaster, From Wikipedia, the free encyclopedia, http://en.wikipedia.org/wiki/bobsled_roller_coaster; Retrieved Apr. 17, 2008, pp. 1-2.
Flying Turns (Knoebels), From Wikipedia, the free encyclopedia, http://en,wikipedia.org/wiki/Flying_Turns_%28Knoebels%29; Retrieved Apr. 17, 2008, p. 1.

* cited by examiner

*Primary Examiner*—S. Joseph Morano
*Assistant Examiner*—Zachary Kuhfuss
(74) *Attorney, Agent, or Firm*—Marsh Fischmann & Breyfogle LLP; Kent A. Lembke

(57) ABSTRACT

A vehicle for use in an amusement park ride to provide a flying corners effect. The vehicle includes a body and a guide slot or groove on the body. The guide slot is shaped for receiving and at least partially capturing or enclosing the track. The guide slot is defined in part by opposing first and second sidewalls that extend along a portion of the body. The guide slot is larger in width than the track such that the vehicle is able to move transversely or side-to-side a predefined distance such as in banked curves. Guides are provided on the sidewalls of the slot. The guides may be spaced apart from the edges when the vehicle is centered on the track and provide guidance after an amount of unrestrained lateral or transverse travel. Arms extend outward from the body to capture the track and prevent the vehicle from tipping.

17 Claims, 8 Drawing Sheets

VEHICLE AND TRACK SYSTEM FOR FLYING CORNER AMUSEMENT PARK RIDES

BACKGROUND OF THE INVENTION

1. Field of the Invention

The present invention relates, in general, to roller coasters and other amusement park rides, and, more particularly, to vehicle and track designs and systems to provide passengers ride experiences with flying corners similar to those experienced in bobsledding in a controlled and safe environment.

2. Relevant Background

Amusement parks continue to be popular worldwide with hundreds of millions of people visiting the parks each year. Park operators continuously seek new designs for thrill rides because these rides attract large numbers of people to their parks each year. Roller coasters and other thrill rides provide numerous twists, turns, drops, and loops at high speeds that many park goers demand. These rides may be gravity driven as is the case with many roller coasters or powered to provide a desired user experience with a particular track configuration. One thrilling portion of these rides is the high speed banking experience as a car or vehicle goes rapidly around a banked corner or bend such as at a portion of the track that is not flat but is instead angled or sloped such that the vehicle is tipped, which forces the passengers to lean or shift to the left or right. Passengers find this exciting because it is an experience they typically cannot obtain in their own vehicles, e.g., with highways typically having relatively low speed limits on any banked curves such as freeway entrance and exit ramps.

The banking sensation is heightened further with amusement park rides that attempt to provide "flying corners." These rides simulate bobsleds with a track that is U-shaped or arcuate in cross section, and wheeled vehicles ride within the track-defined chute or dry flume. In such rides, the cornering is considered a flying corner as the car or vehicle is able to travel transversely relative to the primary direction of travel without mechanical guides or rigid tracking. A well-designed bobsled-type ride may provide flying corners with a unique banking and overall ride experience.

Flying corner rides, however, have not been widely adopted or utilized in amusement parks due to a number of serious limitations. Existing tracks have typically been formed of wood and are very difficult and expensive to fabricate. The tracks generally are very large and deep because escape from the channel is prevented by the depth of the channel (or height of the edges). FIG. 1 illustrates a representative flying corner ride 100 in which an arcuate track 110 is supported by structural members 112. A passenger or guest 130 sits in a seat 128 of a car or vehicle 120 that contacts the inner surface of the track 110 with wheels 124. As the center of gravity, CG, of the car 120 changes such as during a banked corner, the car 120 is able to move transverse to the direction of travel (or the longitudinal axis of the track 110) as shown with arrows 142, 144. The car 120 is prevented from exiting the track 110 by the depth of the channel or flume.

Design of the ride 100 is troubling from a safety viewpoint due to tipping issues and pinch points. Tipping generally has to be addressed with a combination of the design of the car 120 and the size and shape of the track 110, but with no physical restraint, there remains a danger that the car may overturn or tip in the channel. Pinch points are shown in FIG. 1 at locations where the rider 130 may reach outside the car 120 and contact a track or other surface or pinch their fingers or other body parts between the car 120 and track 110 or other surfaces. In existing rides 100, pinch points are minimized by using a relatively large vehicle combined with a larger diameter channel or flume, but this adds to material and other fabrication costs and reduces the intimacy of the ride for the passenger 130.

As a result of these concerns of safety and cost, flying corner rides are not provided at most amusement parks. There remains a need for a method of providing park guests with a thrill ride that provides the sensations associated with a flying corner similar to a bobsled.

SUMMARY OF THE INVENTION

The present invention addresses the above problems by providing a track and vehicle assembly that is adapted for use in an amusement park ride to provide flying corners similar to a bobsled experience. Briefly, the track is shaped such that it defines a channel or flume with a curved or arcuate contact surface between its edges or sidewalls. This "channel" can be shallower than prior bobsled-type rides because the vehicle has a body with a guide slot for receiving and capturing the track. The guide slot is arcuate in shape to match the track (or at least the track contact surface) with sidewalls that define the width (or arc length) of the guide slot. The width is greater than the width of the track to allow the vehicle to move side-to-side on the track such as on banked corners of the track, with the sidewalls or guides provided on the sidewalls providing a limit to travel of the vehicle transverse to the main direction of travel along the track. To address flipping, arms are provided that extend from the body (or from the sidewalls) to define lower contact surfaces of the guide slot. These lower contact surfaces act as upstops by contacting an underside or lower contact surface of the track when the vehicle lifts off of the main or upper contact surface more than a predefined distance (e.g., a small amount of lift may be allowed to enhance the unrestrained flying corner effect of the ride). The arms, thus, act to "capture" the track or ends/edges of the track while providing the vehicle at least a degree of unrestrained banking and transverse travel on the track while preventing the vehicle from escaping the track or tipping over. Since the track is "captured" by the vehicle, there are no pinch points where a passenger could place their hands or articles of clothes between the vehicle and the track, thereby further increasing the safety of a ride using the track and vehicle assembly.

More particularly, a vehicle is provided for use in an amusement park ride. The ride includes an elongate track with a curved or arcuate contact surface that extends between its edges or sides. The vehicle includes a body with one or more seats for passengers or park guests. A guide slot or groove is provided on the body (such as in an undercarriage area) that is shaped for receiving and at least partially capturing or enclosing the track. The guide slot is defined in part by opposing first and second sidewalls. The sidewalls extend along at least a portion of the length of the body, with some embodiments having the slot or groove extending along most or the entire length of the body. The guide slot is larger than the track such that the vehicle is able to move transversely or side-to-side a predefined distance or amount such as in banked curves provided along the track. For example, the guide slot may have a width (or arc length) defined by the first and second sidewalls that is greater than a width of the track as measured between the two edges or sides of the track. In one case, the guide slot is at least 12 inches greater in width such that the vehicle may move transversely at least about 6 inches in either a left or right direction relative to a longitudinal axis of the track prior to the sidewalls or a guide provided on the sidewall contacting the edge or the track to redirect the vehicle along or back toward the main direction of travel. The guides on the sidewalls may be hard or rigidly mounted or may be soft mounted such as with resilient or shock-absorbing members to absorb a portion of the force applied on the vehicle by the track edges.

The vehicle may further include an upper slot wall extending between the first and second sidewalls, and wheels or similar rotatable bearing elements may be mounted on the upper slot wall to provide vertical support when the wheels contact the curved contact surface of the track. A pair of arms in some embodiments extends outward from the body or from the first and second sidewalls, and in these embodiments, the upper slot wall defines an upper surface of the guide slot while the arms define a pair of upstop contact surfaces of the guide slot opposite the upper surface. When the track is received into the guide slot (i.e., the vehicle is mounted onto the track), the upstop contact surfaces are typically spaced apart from a lower contact surface of the track (e.g., a surface opposite the curved contact surface of the track) and the upstop contact surface or skids, bumpers, or the like mounted on such surfaces only contact the lower contact surface of the track when the vehicle lifts off the curved contact surface a predefined maximum amount. For example, the vehicle may be allowed to lift off the track a small amount such as less than several inches or less than about one inch prior to the upstop contact surface contacting the track to, thereby, prevent the vehicle from tipping or escaping the track.

According to another aspect of the invention, a track and vehicle assembly is provided for use in a flying corners or bobsled-type amusement park ride. A track assembly is included that provides a length of track (e.g., one with banked corners) with an upper, arcuate contact surface between two edges (e.g., a channel or flume defined by a track surface with a circle segment cross sectional shape or the like). A vehicle is also provided that includes a body with a slot shaped for receiving the track. The slot is defined in part by a pair of arms that extend from the body toward each other but with a gap between their tips or ends to allow a structural member supporting the track to pass as the vehicle travels along the track. Each of the arms includes an upstop contact surface that is spaced apart a distance from a lower contact surface of the track, whereby the vehicle is stopped by the arms from lifting off of the upper contact surface by more than a preset amount (i.e., about the distance between the upstop contact surfaces and the lower contact surface of the track when the vehicle is supported on the upper contact surface of the track). The arms extend over the edges of the track and each includes an inner sidewall defining a side of the slot adjacent to one of the edges of the track. A guide assembly may be positioned between each of the sidewalls and the track edges, and the guide assembly may include a rotatable member (such as a wheel or roller) in contact with the edges (i.e., sprung in contact) or spaced apart from the edges (i.e., sprung out of contact or hard mounted) to guide the vehicle back along the track after a transverse movement.

In another aspect, an amusement park ride is provided with flying corner effects. The ride includes a track with a channel or flume defined by a contact surface with an arcuate cross section (e.g., a circle segment, a parabolic, an elliptical, or other curved section). A structural assembly is included with members attached to a side of the track opposite the contact surface to structurally support the track in the ride. The ride further includes a body with wheels for contacting the contact surface of the track. Arms extend out from the body to at least partially enclose or "capture" the track, and the arms are spaced apart (or their tips/ends are apart) to define a gap through which the structural support members may pass as the vehicle travels along the track in a direction of travel (e.g., substantially parallel or along a longitudinal axis of the track). The vehicle is also able to travel transverse to the direction of travel at least in banked portions of the track. The arms may each include an inner contact surface that defines a sidewall adjacent an edge of the contact surface of the track and also an upstop portion. The upstop portion contacts a lower contact surface of the track that is opposite the channel, with the contact occurring when the wheels lift off or are spaced apart from the contact surface of the track a predefined maximum lift distance (e.g., less than about 12 inches, or less than about 6 inches, or more typically less than about 2 inches).

Transverse travel is achieved because the sidewalls are spaced apart a distance that is greater than a width of the channel such that the vehicle is able to travel in the channel a predefined maximum transverse travel distance (e.g., up to 3 feet or more from a center line of the channel) before the vehicle abuts or contacts one of the sidewalls. Rotatable guides may be mounted on the sidewalls of the arms to contact the track about when the vehicle travels this predefined maximum transverse travel distance. The rotatable guides (e.g., wheels, rollers, bearings, or the like or with sliding guide(s) (e.g., dry or cushioned by fluid/air) in addition to or in place of wheels or other rotatable guides) may be hard/rigid mounted or may be soft mounted such as on a resilient or spring element. One or more of the arms may be detachably mounted to the body such that the vehicle can be removed for maintenance by detaching the one or more arms and returned after maintenance with the arm(s) being reattached to capture the track.

DETAILED DESCRIPTION OF THE PREFERRED EMBODIMENTS

Figure 1:
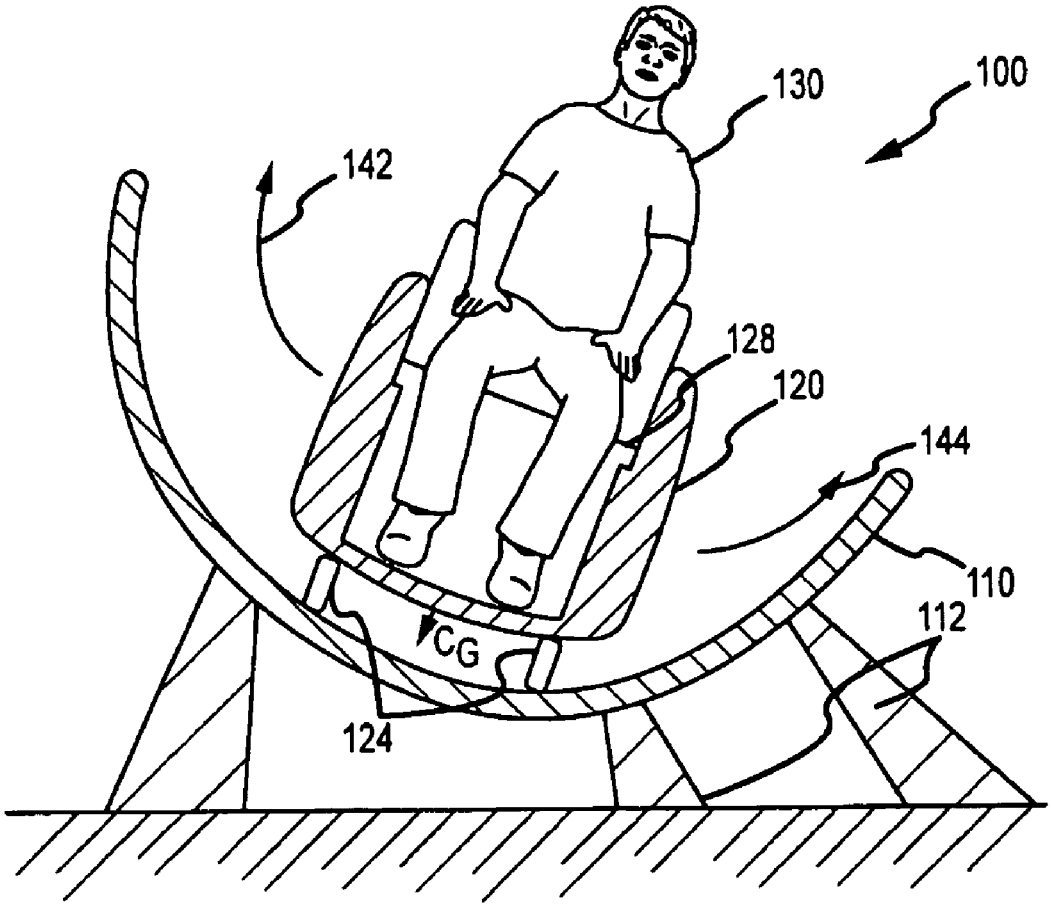
(PRIOR ART) FIG.1
FIG. 1 is a partial sectional end view of a flying corner amusement park ride in which track depth and car size, weight, and other design characteristics are controlled to address safety issues such as overturning, pinch points, and vehicle escape.

Embodiments of the present invention are directed to an amusement park ride or track and vehicle combination for such a ride that provides a guest or rider the sensations and experiences associated with a bobsled. More specifically, embodiments of the invention provide a track and vehicle assembly that allows the vehicle to move transverse to the direction of travel as the vehicle moves through a corner or turn in the track. The transverse movement allows the rider to experience flying corners as the vehicle is able to shift its center of gravity to the left or right as it banks a corner and, preferably, the transverse movement occurs without or with minimal physical restraint to provide the unique ride experience of a flying or un-tethered corner as the vehicle travels up and down the track.

Briefly, the flying corner or unrestrained banking effect is achieved by providing a track with a curved or arcuate contact surface. The track has an arcuate cross section defined by curved tips, edges, or sidewalls that extend upward from a center contact portion, e.g., generally form a C-shaped or U-shaped cross section when viewed along a longitudinal axis. The vehicle is configured to "capture" the track (or at least the contact surface or edges of the channel) with a groove or slot (e.g., a track-capturing guide slot). The guide slot is typically, but not necessarily, provided in the undercarriage or lower part of the body of the vehicle. The guide slot may be thought of as having a mirror-image shape of the track or its contact surface so as to receive the track as the vehicle travels along the track. The curved or arcuate guide slot in one embodiment is formed from a curved section of the undercarriage or lower portion of the body of the vehicle along with a pair of arms that, when the vehicle is positioned on the track, extend over the tips or edges of the track so as to provide upstops on the underside of the track. In other words, the upstop arms contact the underside of the track (e.g., a lower contact surface of the track) if or when the vehicle lifts upward/vertically off of the track more than a preset distance to prevent flipping. The guide slot is designed to have a width greater than a width of the track such that the vehicle can move transversely or side-to-side to provide the flying corner effect such as in banked corners along the track. The track and vehicle are often configured such that no guidance is required to maintain the vehicle on the track, but the guide slot has ends or sidewalls defined by the upstop arms that define the width of the guide slot. These sidewalls (or the width of the slot) act to limit the amount of transverse movement of the vehicle (i.e., act as sidestops or guides) after at least a preset amount of "free" transverse travel is allowed for the vehicle. These and other features of the track and vehicle assembly of the invention that address both the overturning and pinch point issues of prior bobsled designs are described in detail below with reference to FIGS. 2-8.

Figure 2:
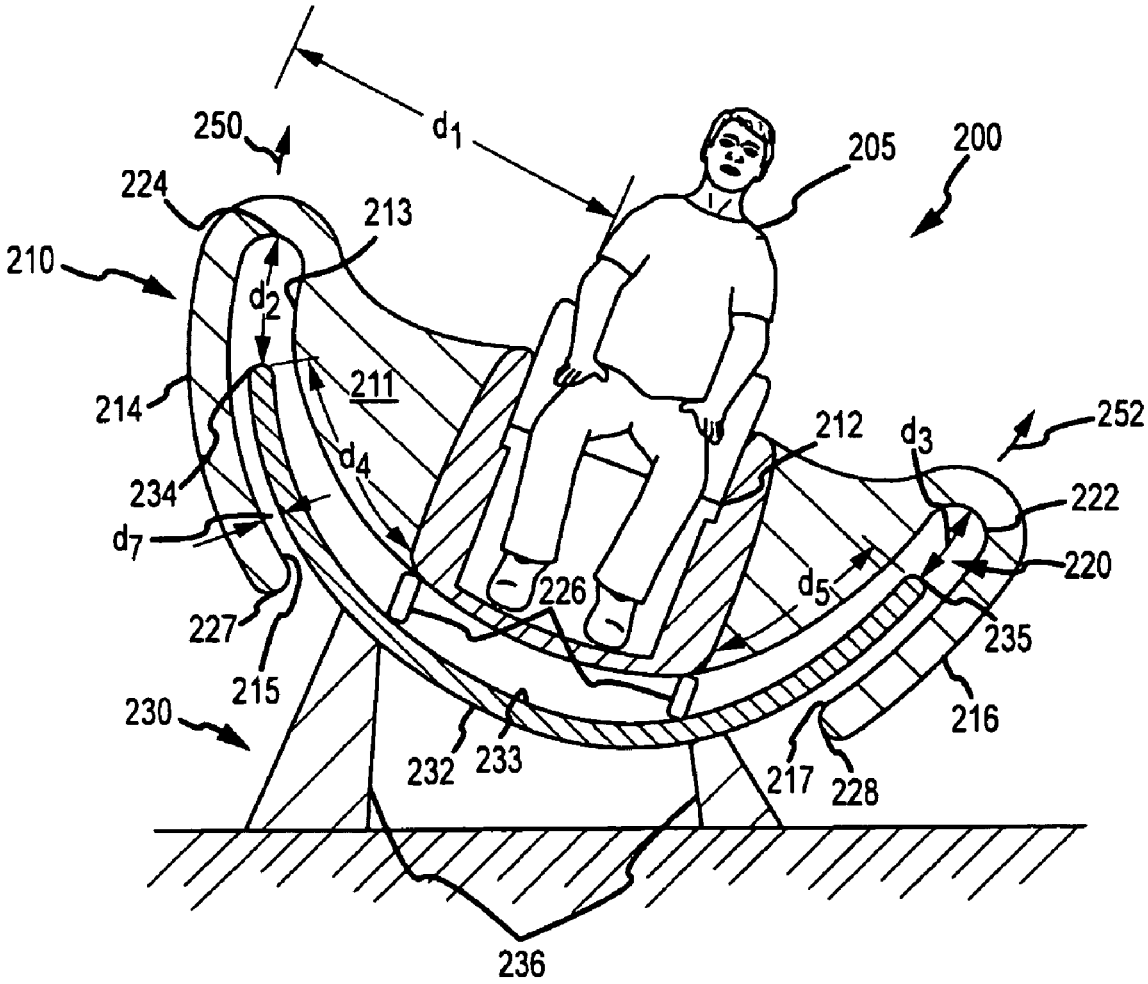
FIG. 2 illustrates an end view similar to that of FIG. 1 showing one embodiment of a vehicle and track combination useful for providing a flying corner amusement park ride.

FIG. 2 illustrates an embodiment of a track and vehicle assembly 200 that may be used to provide a bobsled or flying corners ride to guest or rider 205. As shown, the assembly 200 includes a vehicle 210 and a channel or track (or track flume) structure 230. The track structure 230 includes a channel or track 232 that is physically maintained by supports 232 attached to its underside (or lower contact surface). The track 232 has a curved or arcuate cross sectional shape and provides a curved upper or main contact surface 233 between two tips or sidewalls 234, 235. The specific shape of the channel 232 or contact surface 233 is not limiting to the invention and may vary significantly to practice the invention. Generally, the surface 233 will range from substantially planar to a more C or U-shaped section as shown that may be considered to be a circle segment, a parabola, an ellipse, or simply arcuate in shape. The width of this contact surface, which may be the same as the channel width, may also vary and may be considered an arc length or circle segment length. In prior bobsled designs, the distance between the tips and their height (or shape) had to be selected to prevent a vehicle from traveling outside the defined flume. In contrast, the assembly 200 is adapted such that the vehicle 210 captures the track 232 (or at least the contact surface 233) such that the channel or flume defined by the contact surface 233 does not have to be as "deep" and width (or arc length) of the surface 233 or track 232 does not have to be as great. The specific track width and depth or amount of curve can be chosen to suit the ride experience such as the amount of banking provided, the speed and weight of the vehicle 210, and the desired amount of translational or transverse movement for the vehicle 210.

The vehicle 210 is designed to "capture" the track 232 so as to allow the vehicle to be able to move or translate side-to-side relative to the direction of travel (or longitudinal axis of the track 232) while providing a safe ride experience by preventing the vehicle from overturning or lifting off the track 232. To these ends, the vehicle 210 includes a body 211 with a seat 212 for the guest or rider 205. The body 211 may have a width that is large enough to limit the rider 205 from reaching out and contacting any nearby structure (e.g., by selecting the distance, $d_1$, to be greater than a largest reach of a rider 205) or the ride incorporating the assembly 200 may be designed to eliminate possible structural interferences. The ride assembly 200 is designed, though, such that there are no pinch points between the rider 205 and the track structure 230 as the rider 205 cannot reach over the body 211 to contact the surface 233.

The body 211 includes a guide slot (or track-capturing groove) 220 that is defined in part by an upper slot wall 213. The wall 213 typically is curved similar to the track contact surface 233 such that track 232 is received in the slot 220 (e.g., similar to a tongue and groove joint with the tongue being the track 232 and the groove being the slot 220). The wall 213 may provide the contact or mating surface between the body 211 and the track surface 233 such as by selecting an appropriate material and texture for the wall 213 or by providing skids on the wall 213. More typically, as shown, wheels or load wheels 226 or other similar components are provided on the wall 213 to provide a rotating contact between the vehicle 210 and the track surface 233.

The guide slot 220 is further defined by upstop arms 214, 216 that extend outward from the body 211 and around at least the tips or edges 234, 235 of the track 232 (when the vehicle 210 is mounted on the track 232 in assembly 200). In the assembly 200 shown in FIG. 2, the upstop arms 214, 216 define sidewalls or edges 224, 222 of the guide slot 220 as well as lower slot walls that extend to arm ends or tips 227, 228. The lower slot walls provide contact surfaces or upstops 215, 217 for allowing the vehicle 210 to contact the track 232 on a lower contact surface when or if the vehicle 210 begins to lift or tip a preset amount. As shown, a gap or distance, $d_7$, is provided between the upstop surfaces 215, 217 and the lower contact surface of the track 232, which will vary from less than an inch or several inches depending upon the amount of lift allowed in the assembly 200 during its intended use in an amusement park ride.

The tips 227, 228 extend from the sidewalls or edges 224, 222 a distance (or arc length) selected to provide an upstop surface 215, 217 adequate to control overturning of the vehicle. This distance may be several inches to many feet. The guide slot 220, however, typically will not be fully enclosed by the arms 214, 215 as a space or gap is left between the tips or arm ends 227, 228 to allow the vehicle 210 to pass by the support structures 236 without contact. The size of the gap (e.g., the arc length) is selected to be large enough such that when the vehicle 210 is allowed to translate back and forth in the guide slot 220 the tips 227, 228 have sufficient clearance from the structures 236 (e.g., the distances $d_2$ and $d_3$ are less than distance from the tips 227, 228 to the structure 236 at any particular time/location in the ride).

Significantly, the width of the guide slot 220 is greater than the width of the track 232 (or at least the contact surface 233). This difference in width allows the vehicle 210 to move transverse (or side-to-side) as the center of gravity of the vehicle 210 moves in corners or banks in the track 232, with the transverse or side-to-side movement of the vehicle 210 shown by arrows 250 and 252. As shown, the tips 234, 235 of the track 232 are spaced apart a distance, $d_2$ and $d_3$, from ends or sidewalls 224, 222 of the guide slot 220. In other words, the width of the guide slot 220 exceeds the width of the track 232 by the combined magnitude of these two distances, $d_2$ and $d_3$. The distances are shown to be about equal when the vehicle 210 is riding in the center of the track or channel 232, but they will often differ as the vehicle 210 travels around a flying corner. The track 232 does not have to have high sidewalls to prevent the vehicle 210 from escaping the track 232 because the guide slot 220 is configured to cause the vehicle 210 to contact the track tips 234, 235 with sidewalls or edges 224, 222 as the vehicle 210 reaches a maximum banking height (or maximum transverse movement). The amount of transverse movement or travel allowed may vary to practice the invention but typically will be at least several inches and more often will be 0.5 to 3 feet or more. To prevent the wheels 226 from losing contact with the surface 233, the width of the guide slot 220 (as may be measured by an arc length) may be selected such that distances $d_2$ and $d_3$ are less than the distances $d_4$ and $d_5$ that the wheels 226 (or the vehicle 210) may move in either a left or right direction (or transverse direction relative to the longitudinal axis of the track 232 or direction of travel of the vehicle 210). In some preferred embodiments, the vehicle 210 and track 232 are designed such that in most or all anticipated operating conditions the tips 234, 235 of the track 232 do not contact the sidewalls 224, 222 of the guide slot 220 so as to provide a flying corner experience corresponding to bobsleds, with the sidewalls 222, 224 only contacting the track 232 in limited ways (e.g., as a failsafe or safety precaution when the vehicle does not operate in a design manner). In other cases, the amount of transverse movement may be kept relatively small with the tips 234, 234 contacting the sidewalls 224, 222 on a fairly regular basis to guide the travel of the vehicle 210 along the track 232.

The body 211 including the arms 214 and 216 are shown in FIG. 2 to be formed from a single or unitary structure, but the arms 214, 216 may also be attached to the body 211. For example, the arms 214, 216 may be fastened to the body 211 to allow the vehicle 210 to be removed from the track 232 for maintenance, e.g., by removing or loosening fasteners to allow one or both arms 214, 216 to be removed or to rotate upward. The vehicle 210 may be formed of a variety of materials such as metals, metal alloys, and plastics as long as the strengths and other physical characteristics are selected to withstand expected ride conditions and meet applicable safety standards. Similarly, the track 232 may be fabricated of a variety of materials such as metal or metal alloy or reinforced concrete. The thickness of the track 232 can vary, too, and the thickness (or depth) of the guide slot 220 is preferably selected to suit this chosen track thickness (e.g., to provide room for any wheels 226 and provide a desired clearance, $d_7$, from the upstop arms 214, 215 or upstop contact surfaces 215, 217).

Figure 3:
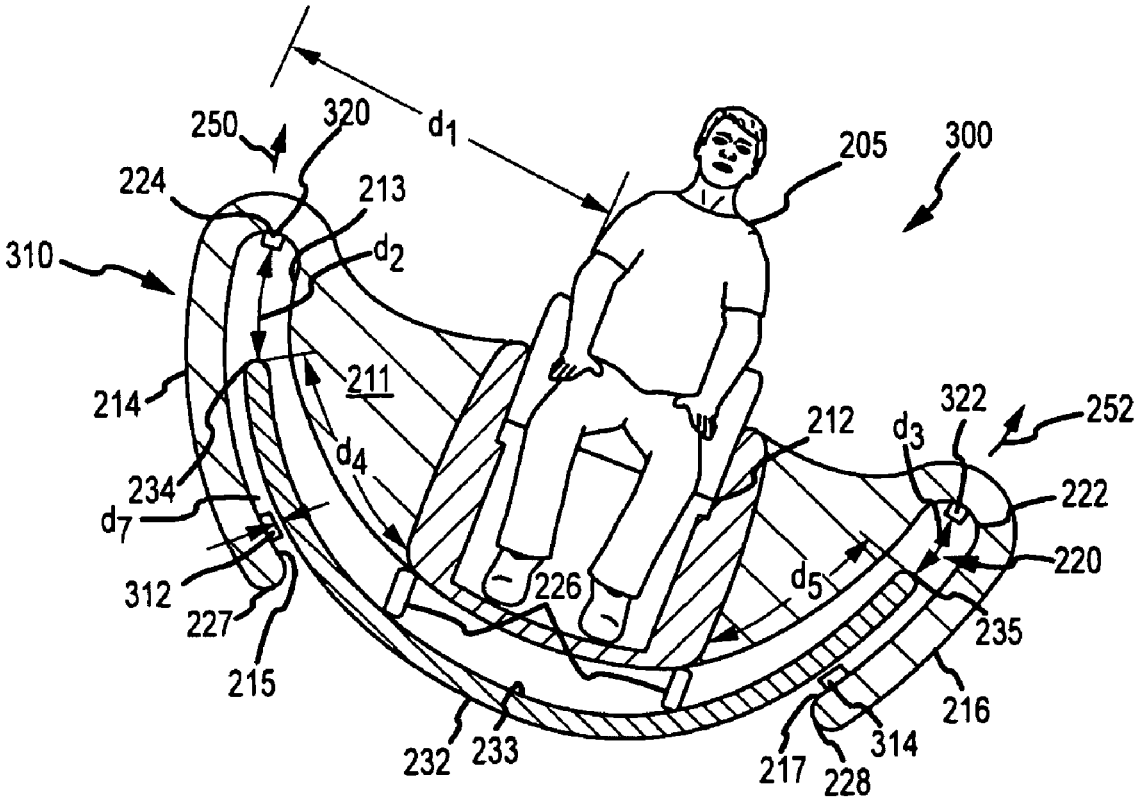
FIG. 3 illustrates an end view similar to that of FIG. 2 of another embodiment of a vehicle and track assembly useful for providing flying corner effects with use of upstop wheels and skids within a capture or guide slot formed in the vehicle body.

FIG. 3 illustrates a track and vehicle assembly 300 that uses the track 232 with an alternative embodiment of a vehicle 310. The vehicle 310 differs from vehicle 210 as it includes upstops 312 and 314 on the arms 214, 215 and, specifically, on the contact surfaces 215, 217. These upstops 312, 314 may be simple skids or bumpers made of a hard material such as a plastic, metal, or ceramic or they may provide some resilience or cushion and be made of a rubber or the like. The upstops 312, 314 may be provided as spaced apart components along the length of the arms 214, 216 (e.g., along the longitudinal axis of the body 211) or be elongate members running the length or a substantial portion of the arms 214, 216 (e.g., as measured along the longitudinal axis of the vehicle 310). In other cases, the upstops 312, 314 may be rotatable to spin when contact occurs between the track 232 and the arms 214, 216 such as rollers, casters, wheels, or the like. Typically, the upstops 312, 314 are spaced apart some minimum distance, $d_7$, from the lower contact surface of the track 232 and only contact the vehicle 310 to prevent an undesired amount of lift. In other embodiments, the clearance, $d_7$, is relatively small such as less than 0.5 to 1 inch such that contact occurs more frequently or on a nearly ongoing basis. Upstops may further be designed to run in constant contact with the lower track surface 232. Upstops in any configuration can involve a sprung degree of freedom.

The vehicle 310 also includes transverse motion guides or contacts 320, 322 mounted on the sidewalls or edges 224, 222 of the guide slot 220. These guides 320, 322 are typically relatively rigid and may be formed similar to upstops 312, 314 such as bumpers or skid surfaces made of metal, plastic, hard rubber, or the like or provided as a rotatable element. The guides 320, 322 act to define the width of the guide slot 220 and are spaced apart from the tips 234, 235 of the track 232 (e.g., the width of the guide slot 220 is preferably greater than the width of the track 232 even with the use of guides 320, 322 to allow at least some amount of unrestrained or unguided side-to-side or translational movement of the vehicle 310). Again, the guides 320, 322 may be provided as single components such as an elongate skid or bumper in the slot 220 or as a number of spaced apart members along the length of the car 310 and its slot 220.

Figure 4:
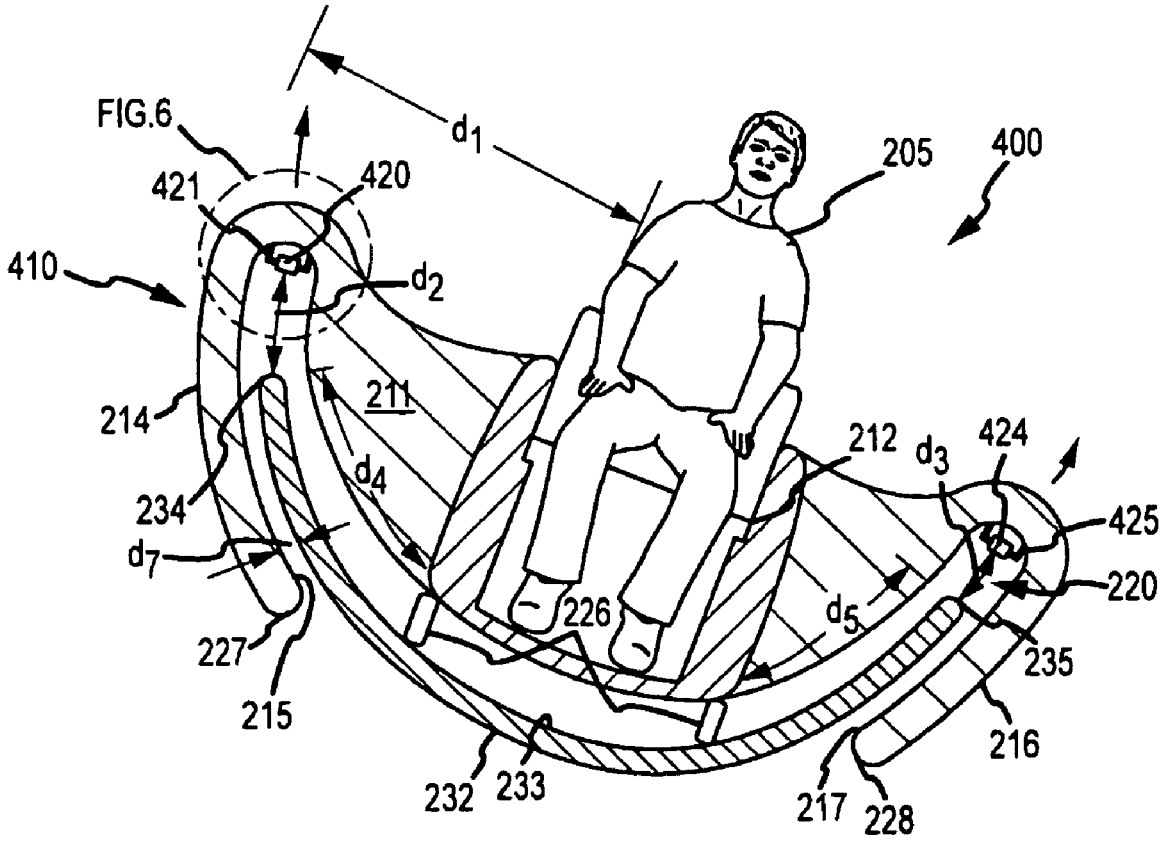
FIG. 4 illustrates an end view similar to that of FIGS. 2 and 3 of a vehicle and track assembly of the invention that includes guide wheels or rotatable guides within the guide slot to control transverse travel of the vehicle.

FIG. 4 illustrates a track and vehicle system 400 of the invention that uses the track 232 but that provides another embodiment of a vehicle 410. This vehicle 410 differs from vehicle 210 of FIG. 2 in that it includes rigid or hard mounted guides 420, 424 that are shown attached to the sidewalls 222, 224 of the guide slot 220. The guide slot 220 with the guides 420, 424 in place has a width that is larger (e.g., the width of the guide slot 220 is defined by the guides 420, 424) than the width of the track 232. The guides 420, 424 may be wheels or rollers mounted on a spindle or axle and are typically spaced apart from the tips 234, 235 as shown by distances $d_2$ and $d_3$. This spacing, as discussed above, allows the vehicle 410 to ride up on the track surface 233 toward the tips 234 and 235, but overall transverse travel is limited to the distances $d_2$ and $d_3$ by the guides 420, 424. The tips 234, 235 may be shaped to spread the contact area between the tips 234, 235 and the guides 420, 424 over a larger area (e.g., to avoid a point application of load or collision forces). For example, the track tips 234, 235 may include a relatively planar surface that is larger than the width of the wheels or rollers 420, 424 and is angled or positioned for relatively full contact with the wheels 420, 424 as the vehicle translates to its fullest side travel.

Figure 6:
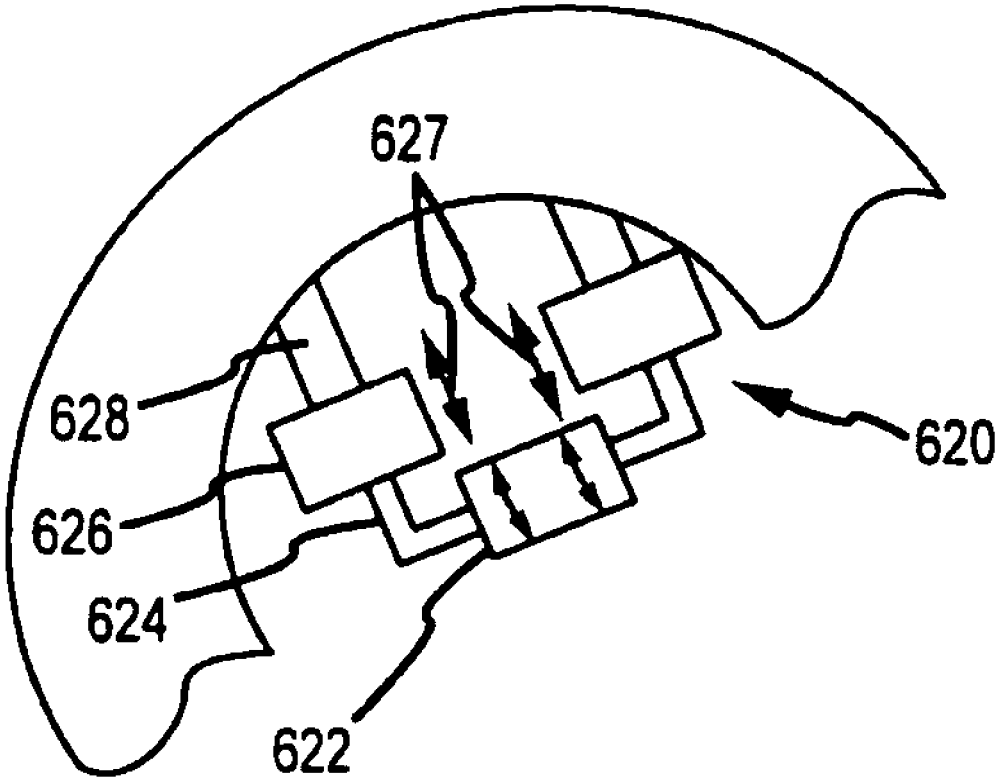
FIG. 6 illustrates a guide assembly that may be used with the vehicle and track assembly of FIG. 4 to provide spaced-apart guide wheels that are mounted to dampen contact between the track or channel and the inner surfaces of the vehicle guide slot.

In some cases, it may be desirable for the guides 420, 424 to be spaced apart and also soft mounted, e.g., to provide some shock absorption properties so as to provide soft redirects of the vehicle. To this end, FIG. 6 illustrates one embodiment of a guide assembly 620 that may be used for the guides shown in FIGS. 3 and/or 4. As shown, the assembly 620 includes a pair of rods 628 attached to the arms or sidewalls of the guide slot. On the rods 628, a pair of resilient members 626 is provided that in turn support an axle 624 upon which a rotating guide 622 is provided (e.g., a wheel, bearing, roller, or the like). As shown by arrows 627, the resilient members 626 allow the guide 622 to receive contact the edge of the track and to then have a portion of the force or shock resiliently absorbed. The members 626 may be spring-based shock absorbers or take on other arrangements that provide the soft mounting function rather than providing a hard mounting of the guide 622, which may cause a hard bounce for the vehicle at the end of the range of transverse travel or movement. The assembly 620 may be considered or labeled as guide wheels with a damper that are mounted on the vehicle out of contact (e.g., sprung out of contact). In other cases, the guide wheels may be provided on the track edges instead of on the vehicle (e.g., series of guide wheels, rollers, or the like on the track edge).

Figure 5:
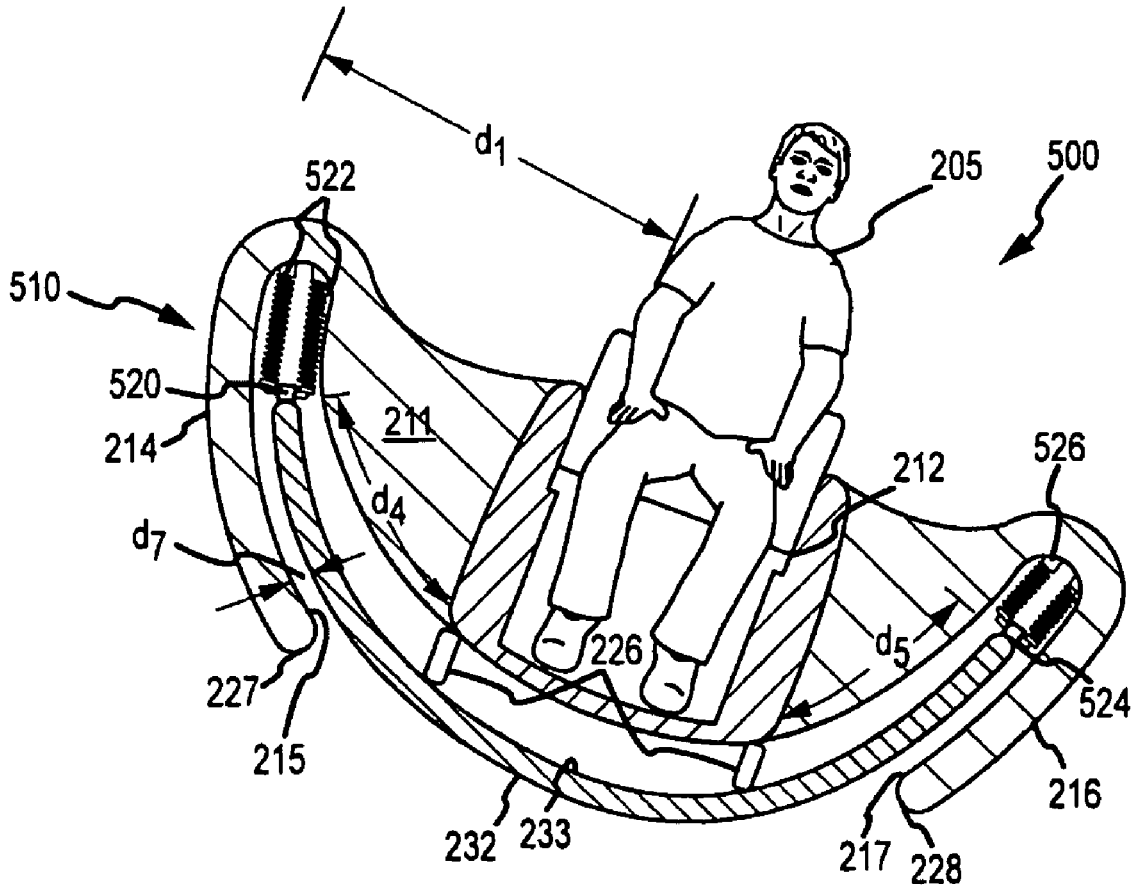
FIG. 5 shows another vehicle and track system that can be used to provide flying corners that uses a sprung guide wheel to guide the vehicle relative to the track while allowing a range of transverse motion.

FIG. 5 illustrates another track and vehicle assembly 500 that provides a dampened guide for controlling side-to-side or transverse travel but, in contrast to FIG. 6, the guide is provided in contact with the track. As shown, the assembly 500 includes the curved track 232 and wheels 226 contact an upper surface 233 of the track 232. The vehicle 510 may include upstops on the arms 214, 216 as shown in FIG. 3 or allow the surfaces 215, 217 to be used as potential upstop contact surfaces as shown. The vehicle 510 includes soft or dampened side guides as provided by guides (e.g., wheels, rollers, or non-rotating elements) 520, 524 that are "sprung" or provided to abut the edges of the track 232. The guides 520, 524 are not hard mounted because it is desirable to allow the vehicle 510 to have a range of transverse or side-to-side movement (e.g., a few inches up to a foot or more) to create a sensation similar to a bobsled in banked corners of the track 232.

The guides 520, 524 are mounted with dampeners or absorbers 522, 526, which may be spring-based shock absorbers or other resilient members. In some embodiments, the dampeners 522, 526 are chosen to allow the initial transverse movement of the vehicle 510 to occur with negligible, or at least less, resistance while providing more resistance toward a maximum amount of travel in one direction (e.g., a resistive or counter spring force may be applied proportional to the amount travel). The dampeners 522, 526 provide resistance in tension as the vehicle attempts to travel transversely but in an opposite direction to one of the dampeners 522, 526, but this force is typically less than the resistive force applied by the dampener 522, 526 under compression by movement of the vehicle 510. The assembly 500 provides a guided vehicle while still giving the rider 205 the sensation of flying corners.

Figure 7:
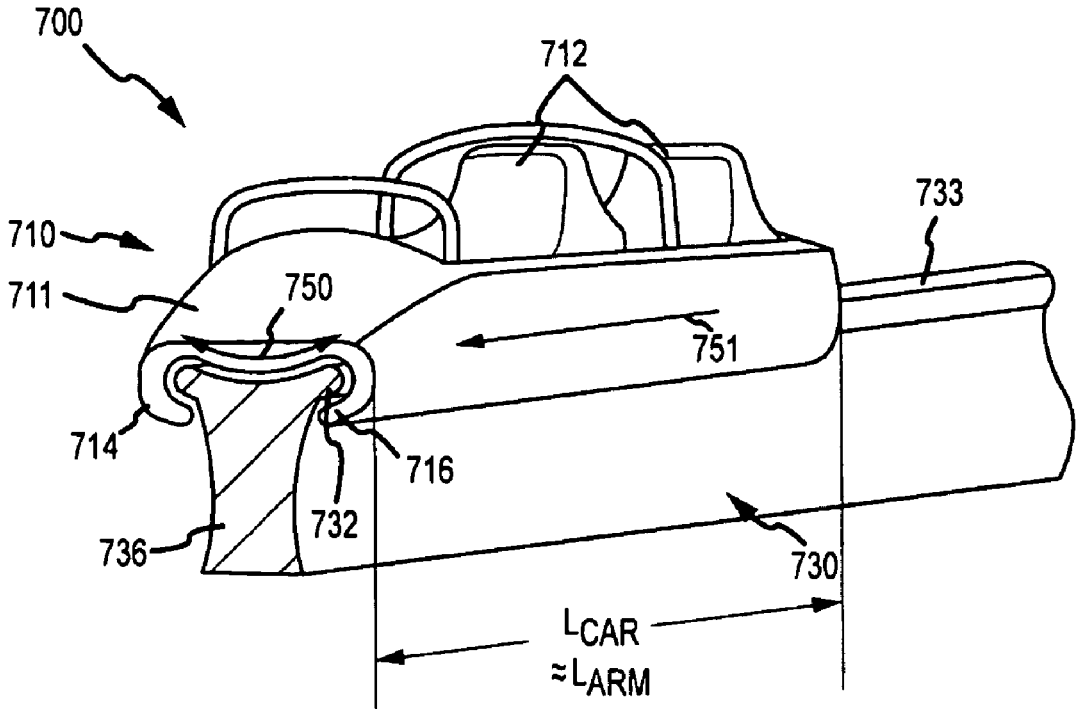
FIG. 7 is a perspective view of a vehicle and track assembly (or ride system) of the invention showing a vehicle mounted on a track or channel and showing capturing arms that extend along the length of the vehicle (or a significant portion of the vehicle with only one arm provided per side of the vehicle)

FIG. 7 illustrates another embodiment of a track and vehicle assembly 700 of the invention. As shown, a track assembly 730 is provided that includes a track 733 with a curved, upward facing contact surface (e.g., a circle segment with a particular arc or segment length). The track 733 is supported on or protrudes from support member 736. The assembly 700 further includes the vehicle or car 710 mounted to ride upon the track 733 such as with skids or wheels that ride upon the contact surface of track 733. The vehicle 710 has seats 712 for passengers or guests (e.g., 2 to 6 or more guests). The vehicle 710 has a body 711 than has a length, $L_{car}$, and during operation the vehicle 710 travels along the track 733 in the direction shown with arrow 751 (i.e., the direction of travel). The vehicle 710 may be a powered vehicle or may move based on gravity (e.g., as is the case with many roller coaster-type rides).

Although shown in a straight, non-banked form, the track assembly 730 may have sections where the track 733 is provided in banked curves with a substantial portion of the contact surface of the track 733 provided at an angle relative to a horizontal plane. In such banked portions of the ride assembly 700, the vehicle 710 is able to move transversely relative to the direction of travel 751 as shown with arrow 750. To allow this to occur safely, the vehicle 710 includes arms 714, 716 that extend over and capture or enclose the tips or ends 732 of the track 733. The arms 714, 716 define a guide slot or groove shaped to receive the track 733 and with a width and thickness (or height) greater than the width and thickness of the track 733. In some cases, the width of the guide slot may only be a few inches greater but in other applications the width of the guide slot may be several feet greater to allow the vehicle 710 a significant amount of travel transverse to the direction of travel 751 or longitudinal axis of track 733 such as 0 to 3 feet or more in either direction. In the embodiment shown, the arms 714, 716 each extend all or substantially all of the length of the car, $L_{car}$ (i.e., $L_{car}$ is approximately equal to or equal to the length of the arms, $L_{arm}$).

Figure 8:
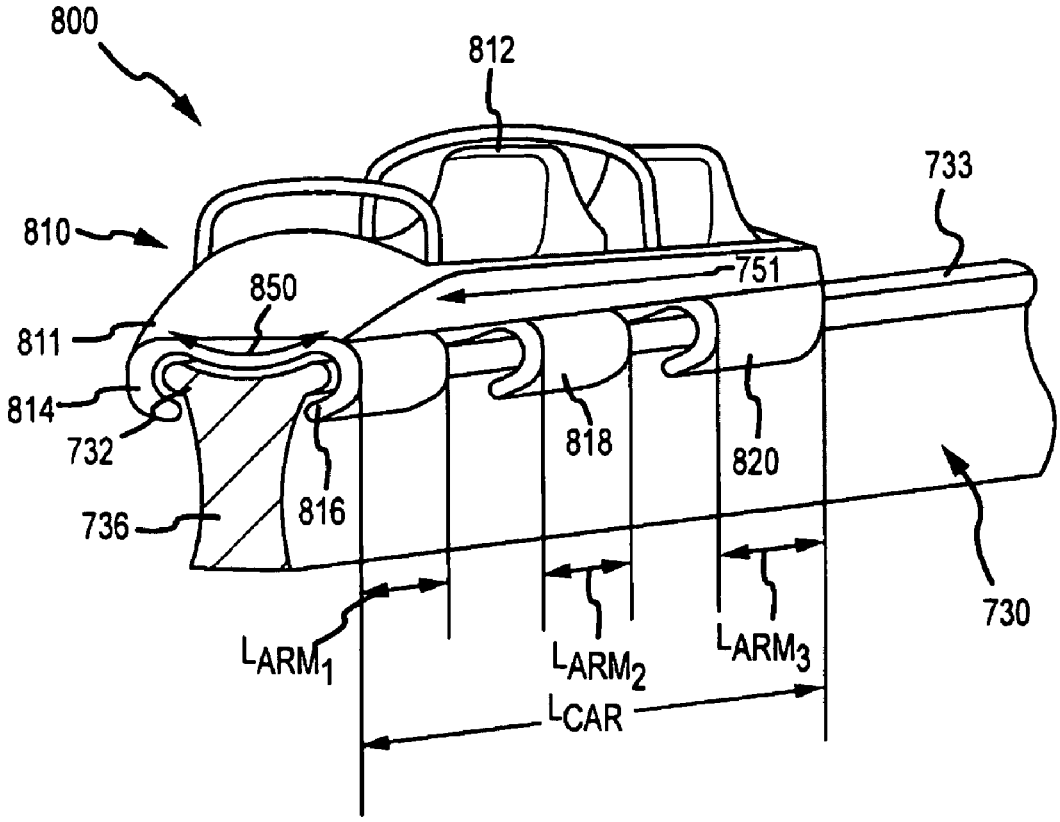
FIG. 8 is a perspective view of another vehicle and track assembly of the invention showing the use of multiple pairs of retaining or track capture arms to contact enclose or capture the track to prevent overturning while allowing transverse movement or flying corners.

FIG. 8 illustrates another track and vehicle assembly 800 useful for providing a flying corner ride. As with the assembly 700 of FIG. 7, the assembly 800 includes a track assembly 730 with a track 733 on support 736. A vehicle 810 is provided that includes a body 811 with seats 812 for guests and, during use, the vehicle 810 travels mainly along the track 733 in the direction 751 (i.e., parallel to the longitudinal axis of the track 733), but the vehicle also travels transversely or side-to-side as shown by arrow 850. This is achieved, in this case, by two or more pairs of arms as shown by pair 814, 816 and arms 818 and 820. The arms extend about the tips 732 of the track 733 and each pair is spaced apart along the length of the car, $L_{car}$, as shown by the gaps between arm 816 and arm 818 and between arm 818 and arm 820. The lengths of the arms, $L_{ARM1}$, $L_{ARM2}$, and $L_{ARM3}$, are typically equal but this is not required and in some cases the lengths may differ from each other, but, in any case, the arm lengths are less than the length of the car, $L_{car}$. In addition to varying lengths, multiple arms could be allowed to articulated about a center pivot to allow the track to roll in and out of corners. In each pair of arms, there is a gap between the tips of the arms for the support 736, and, as discussed for other embodiments, the guide slot is defined by the arms to have a width that is greater than the width of the track 733 to allow transverse movement 850 of the vehicle 810. As with assembly 700, the assembly 800 may be configured to include upstops and guides as discussed with reference to FIGS. 3-6.

Although the invention has been described and illustrated with a certain degree of particularity, it is understood that the present disclosure has been made only by way of example, and that numerous changes in the combination and arrangement of parts can be resorted to by those skilled in the art. For example, modifications may be made to the track and vehicle assemblies illustrated to provide a reduced or desired mating surface between the upper contact surface of the track and the upper guide slot wall. This may be a pure skid contact with skids provided on the vehicle body and in such embodiments a lubricant may be provided to reduce friction such as by providing water, compressed air, or the like in the guide slot between the vehicle and the track (e.g., the track and vehicle assembly may be provided as part of a water ride such as a flume waterslide or water or another liquid may be used to provide a thin film to reduce friction). Friction forces may also be reduced and a unique ride experience created by icing the track or vehicle. Other embodiments may provide rollers, wheels, bearings, or other rotating members on the track (such as on the upper and/or lower contact surfaces of the track and/or on the edges or sides that contact the sidewalls of the guide slot).

Other embodiments or variants of use of the arm(s) to capture the track may relating to the channel/flume may include the following. The cross section width of the flume may be increased to intentionally take up the side-to-side travel present in the fundamental design. This might be done for purposed of loading/unloading and/or show reasons. In addition to the potential removal of arms for maintenance, a special area of track could be utilized with: (a) a minimum cross section such that the vehicle could be hoisted off the track from above; and/or (b) an open ended piece such that the vehicle could be driven off onto a forklift dolly or the like. Multiple running wheels may be used such as more than two wheels side-to-side whereby a running wheel may be allowed to hang off the surface of the track during side-to-side motion.

I claim:

1. A vehicle for use in an amusement park ride, the ride including an elongate track with a curved contact surface extending between two edges, comprising:

a body with at least one seat for a passenger; and a guide slot provided on the body for receiving and at least partially capturing the track, wherein the guide slot is defined by opposing first and second sidewalls extending at least a portion of the length of the body and wherein the guide slot has a width defined by the first and second sidewalls that is greater than a width of the track as measured between the two edges, whereby a center of gravity of the body moves towards at least one of the edges of the curved contact surface a predefined distance transverse to a direction of travel for the vehicle as the vehicle moves along portions of the track.

2. The vehicle of claim 1, wherein the width of the guide slot is at least 12 inches greater than the width of the track, whereby the predefined distance is at least 6 inches.

3. The vehicle of claim 1, further comprising an upper slot wall extending between the first and second sidewalls and a pair of arms extending outward from the first and second sidewalls, wherein the upper slot wall defines an upper surface of the guide slot and the arms define a pair of upstop contact surfaces opposite the upper surface, at least one of the upstop contact surfaces contacting the track when a spacing between upper slot wall and the track exceeds a predefined maximum lift distance, whereby the body is allowed to lift off the track a distance without restraint.

4. The vehicle of claim 3, wherein the track is physically supported by a support member and each of the arms extends outward from one of the sidewalls to a tip, the tips of the arms being spaced apart a distance, whereby when the vehicle receives the track in the guide slot the support member passes between the tips of the arms without contacting the arms.

5. The vehicle of claim 3, further comprising wheels attached to the upper slot wall for supporting the vehicle on the curved contact surface of the track, wherein the pair of upstop contact surfaces are spaced apart from a lower contact surface of the track provided opposite the curved contact surface when the wheels are in contact with the curved contact surface.

6. The vehicle of claim 1, wherein the vehicle is unrestrained from traveling the predefined distance transverse to the direction of travel.

7. The vehicle of claim 6, further comprising a guide mounted on each of the first and second sidewalls for guiding the vehicle toward the direction of travel on the track by abutting the edges of the track upon the vehicle traveling the predefined transverse distance.

8. The vehicle of claim 7, wherein the guides each comprise a resilient member for absorbing at least a portion of a force applied by the track upon the vehicle during contact between the edges of the track and the guides.

9. A track and vehicle assembly for use in a flying corners amusement park ride, comprising:

a track assembly including a length of track comprising an upper, arcuate contact surface between two edges; and a vehicle comprising a body with a slot shaped for receiving the track, wherein the slot is defined in part by a pair of arms extending from the body and toward each other, each of the arms including an upstop contact surface spaced apart a distance from a lower contact surface of the track opposite the upper, arcuate contact surface when the body is supported upon the upper, arcuate contact surface, and wherein at least one of the upstop, contact surfaces abuts the lower contact surface when the body lifts vertically off the upper, arcuate surface the distance between the arms and the lower contact surface, whereby the vehicle has a range of vertically unrestrained movement during movement over portions of the track.

10. The assembly of claim 9, wherein the track assembly further comprises a structural member supporting the track and wherein each of the arms extends to a tip and the tips are spaced apart to form a gap in the slot, whereby the vehicle travels on the track with the structural member passing through the gap.

11. The assembly of claim 9, wherein the arms each extends over one of the edges of the track and each includes an inner sidewall defining a side of the slot adjacent one of the edges of the track, the sides of the slot defining a width of the slot greater by at least 12 inches than a width of the track as measured between the edges of the track.

12. The assembly of claim 11, further comprising a guide assembly positioned between each inner sidewall and an adjacent one of the edges of the track, each of the guide assemblies including a rotatable member abutting the adjacent one of the edges and a resilient member attached to the rotatable member adapted to allow at least some amount of transverse movement of the body of the vehicle relative to a longitudinal axis of the track.

13. The assembly of claim 11, further comprising a guide assembly positioned between each of the inner sidewalls and an adjacent one of the edges of the track, each of the guide assemblies including a rotatable member spaced apart a distance from the adjacent one of the edges, whereby the vehicle travels unrestrained transverse to a longitudinal axis of the track across the distance between the rotatable member and the adjacent one of the edges.

14. The assembly of claim 9, wherein the upper, arcuate contact surface has a cross sectional shape corresponding to a circle segment.

15. An amusement park ride with a flying corner effect, comprising:

a track with a channel defined by a contact surface with an arcuate cross section;

a structural assembly with members attached to a side of the track opposite the contact surface to structurally support the track; and a vehicle with a body including wheels for contacting the contact surface and arms extending from the body to at least partially enclose the track, the arms being spaced apart to define a gap through which the members of the structural assembly pass as the vehicle travels along the track, wherein the vehicle travels along a direction of travel in the channel and travels transverse to the direction of travel at least in banked portions of the track, wherein the arms each include an inner contact surface defining a sidewall adjacent an edge of the contact surface of the track and an upstop portion, the upstop portion contacting a lower contact surface of the track opposite the contact surface of the track when the wheels are spaced apart from the contact surface of the track a predefined maximum lift distance, wherein the sidewalls are spaced apart a distance greater than a width of the channel, whereby the vehicle is able to travel in the channel transverse to the direction of travel a predefined maximum transverse travel distance prior to contacting one of the sidewalls, and wherein a rotatable guide is mounted on the sidewall to contact the track about when the vehicle travels the predefined maximum transverse travel distance.

16. The amusement park ride of claim 15, wherein the rotatable guide includes a resilient element and a roller mounted on the resilient element for contacting the track.

17. The amusement park ride of claim 15, wherein at least one of the arms is detachably mounted to the body, whereby the vehicle can be mounted upon the track and the at least one arm is attached to the body to capture the track.

* * * * *